United States Patent [19]

Imao et al.

[11] Patent Number: 4,704,328

[45] Date of Patent: Nov. 3, 1987

[54] COMPOSITE MOLDED ARTICLES HAVING SPECIFIED UNDERCOAT COMPOSITION

[75] Inventors: Shoji Imao; Hideo Nakamoto; Norihisa Osaka; Masatoshi Takesue; Hitoshi Kodama; Kinuko Suzuki, all of Aichi; Masataka Inomoto, deceased, late of Miyazaki, all of Japan, by Kazuko Inomoto, legal representative

[73] Assignee: Mitsubishi Rayon Co., Ltd., Tokyo, Japan

[21] Appl. No.: 788,289

[22] Filed: Oct. 17, 1985

[30] Foreign Application Priority Data

Oct. 17, 1984 [JP] Japan ..... 59-218115
Oct. 19, 1984 [JP] Japan ..... 59-220071

[51] Int. Cl.[4] ..... B32B 5/16; B32B 15/02; B32B 17/04; B32B 19/02

[52] U.S. Cl. ..... 428/324; 428/325; 428/328; 428/329; 428/330; 428/331; 428/697; 428/698; 428/699; 428/701; 428/702

[58] Field of Search ..... 428/702, 699, 698, 701, 428/697, 325, 329, 330, 328, 331, 324

[56] References Cited

U.S. PATENT DOCUMENTS 2,320,329 5/1945 Meduna .
3,440,132 4/1969 Koubek ..... 428/698 X
3,775,208 11/1973 Grigoleit et al. .
4,221,697 9/1980 Osborn et al. ..... 428/331 X
4,309,474 1/1982 Hodes et al. ..... 428/328

FOREIGN PATENT DOCUMENTS 971981 10/1964 United Kingdom .

OTHER PUBLICATIONS

Patent Abstracts of Japan, vol. 7, No. 285, 58-164775.

*Primary Examiner*—John E. Kittle
*Assistant Examiner*—Susan S. Rucker
*Attorney, Agent, or Firm*—Sughrue, Mion, Zinn, Macpeak, and Seas

[57] ABSTRACT

An undercoat composition for ceramic flame spraying and composite molded articles produced using the undercoat composition are disclosed. The undercoat composition comprises an inorganic filler component having complex irregularities in the surface thereof and an organic binder component. The composite molded articles comprises a substrate, a ceramic flame sprayed coating, and an intermediate layer between the substrate and the ceramic flame sprayed coating, said intermediate layer being made of the above undercoat composition. The present undercoat composition permits good ceramic flame spraying, and there can be obtained composite molded articles having good impact resistance and environmental resistance.

8 Claims, 5 Drawing Figures

NICKEL POWDER (SPHERICAL)

3000 x MAGNIFICATION

NICKEL POWDER (PLATE-SHAPED)

3000 x MAGNIFICATION

COMPOSITE MOLDED ARTICLES HAVING SPECIFIED UNDERCOAT COMPOSITION

FIELD OF THE INVENTION

The present invention relates to an undercoat composition having good environmental resistance and high impact resistance, which when applied in forming a spray deposit of ceramic, strongly adheres the spray deposit to a substrate; the invention also relates to composite molded articles using said composition.

BACKGROUND OF THE INVENTION

When ceramics are coated on a substrate such as metal or plastic, affinity or chemical bonding such as is obtained with typical organic coating agents cannot be expected between the coating of ceramic and the substrate; that is, the adhesion between the coating of ceramic and the substrate is usually very small and unsuitable for practical use. In order to overcome the above disadvantage, a method of roughening the surface of the substrate by sand blasting, for example, so as to enhance the adhesion between the substrate and the spray deposit by the so-called "anchor effect" has been described. For example, a method of finishing a graphite shaft of a golf club, which is molded by solidifying a graphite fiber/epoxy resin mixture, by fusing a metallic powder by the plasma flame-spraying method is disclosed in Japanese Patent Application (OPI) No. 65335/75 (the term "OPI" as used herein means a published unexamined Japanese patent application"). This method, however, has various disadvantages. For example, surface roughening cannot be carried out satisfactorily (depending on the type of the substrate), the flame sprayed component cannot sufficiently enter the inside of the roughened surface, and the spray deposit peels apart from the substrate by the action of a volatile component released from the roughened surface due to the heat of the spray droplets. Thus it is difficult to always obtain sufficiently high adhesion.

SUMMARY OF THE INVENTION

The present invention is intended to overcome the above problems, and an object of the present invention is to provide an undercoat composition for ceramic flame spraying which is excellent not only in initial adhesion (adhesion strength before environmental testing) but also in secondary adhesion (adhesion strength after environmental testing such a thermal shock testing), and also to provide composite molded articles using the undercoat composition.

Thus, the present invention provides an undercoat composition for ceramic flame spraying, comprising an inorganic filler having complex irregularities in the surface thereof and an organic binder.

DETAILED DESCRIPTION OF THE INVENTION

Figure 1:
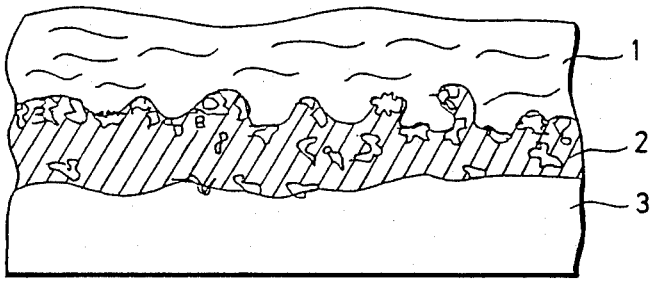
FIG. 1 is a schematic cross-sectional view of a composite molded article according to the present invention.

The undercoat composition for ceramic flame spraying of the present invention comprises an inorganic filler component having complex irregularities in the surface thereof and an organic binder component, wherein the inorganic filler component having complex irregularities means an inorganic filler component such as dendritic nickel having a specific surface area of at least 0.5 $m^2/g$. Preferably the undercoat composition of the present invention comprises an inorganic filler component satisfying the relationship (1)

$$\lambda \cdot S \geqq 5.0 \times 10^{-2} \quad (1)$$

wherein $\lambda$ is a heat conductivity represented in terms of $cal.cm^{-1}.sec^{-1}.deg^{-1}$, and S is a surface area represented in terms of $m^2.g^{-1}$, in combination with the organic binder component.

The inorganic filler component of the present invention is not particularly limited, and includes elements, alloys, composite materials, oxides, nitrides, and carbides of inorganic compounds generally referred to as metals, and compounds or salts of the inorganic compounds and nonmetals. For example, nickel, aluminum, copper, iron, tin, zinc, silver, platinum, palladium, chromium, silicon, arsenic, antimony, bismuth, selenium, tellurium, carbon, alumina, silica oxide, silicon carbide, titania, zirconia, boron nitride, silicon nitride, zirconium nitride, tungsten carbide, silicon carbide, magnesium zirconate, and asbestos can be used, alone or as mixtures comprising two or more thereof.

The shape of the inorganic filler component may be spherical, branched, columnar, or in a composite form thereof. In addition, the inorganic filler component may be in a form resulting from coagulation or fusion of particles having various shapes while retaining their original shapes. It is necessary for the inorganic filler component to have complex irregularities in the surface thereof.

If ceramic flame spraying is applied on an undercoat layer containing the inorganic filler having irregularities in the surface thereof, a flame spraying material attaches to the inorganic filler, thereby producing a ceramic flame-sprayed article which is excellent not only in primary adhesion but also secondary adhesion after an environmental resistance test.

The irregularities are sufficient if the flame spraying material can attach to the inorganic filler. It is more preferred that in the case of spherical, columnar and flat fillers, the surface area is more than two times as large as that of a corresponding true sphere, column or plate, or in the case of polyhedral fillers, the surface area is more than two times as large as that of a corresponding polyhedron having 8 or less surfaces.

In the present invention, when the $\lambda \cdot S$ value of the relationship (1) is less than $5.0 \times 10^{-2}$, even though $\lambda$ is large, an anchor effect of the spray deposit cannot be expected because S is extremely decreased. Undesirably, therefore, even if the spray deposit can be formed, its impact resistance and its durability against thermal impulse are poor. On the other hand, if λ is small and S is large, the spray deposit is formed only with difficulty because the spray deposit is not sufficiently coagulated. In particular, when plastics having a small heat conductivity are used as the substrate, this tendency becomes marked and the resulting spray deposit is unsuitable for practical use.

The organic binder component of the present invention is not critical. Typical thermoplastic resins such as an acryl resin, a vinyl acetate resin, an epoxy resin, a urethane resin, and an alkyd resin, and typical thermosetting resins such as an acryl/melamine resin, an acryl-/urethane resin, and a curing agent-containing epoxy resin can be used.

The undercoat composition of the present invention is prepared by compounding the organic binder component with the inorganic filler component. This undercoat composition can be used in any desired form such as a solution in a suitable organic solvent, or in an aqueous solution or emulsion. In order to stabilize the above solution or emulsion and to maintain the uniformity of the undercoat layer, a dispersion-stabilizing agent, a precipitation-preventing agent, a thixotropy-imparting agent, and the like may be added.

In the practice of the present invention, the mixing ratio of the inorganic filler component to the organic binder component can be appropriately chosen depending on conditions under which the undercoat layer is formed. The inorganic filler content of the composition is preferably from 15 to 80 vol% and more preferably from 20 to 60 vol %. If the inorganic filler component content is less than 15 vol%, the effect of the present invention tends to be obtained less sufficiently, and a ceramic coating layer having good environmental resistance and good impact resistance becomes difficult to produce.

The substrate to which the undercoat composition of the present invention is applied is not critical. For example, even if the undercoat composition of the present invention is coated on an inorganic material of, e.g., metal and then ceramic flame spraying is applied thereon, a sufficiently satisfactory effect can be obtained. In general, however, when the undercoat composition of the present invention is coated on a resinous material and then ceramic flame spraying is applied, a particularly excellent effect can be obtained.

The above resinous material may be made of a thermoplastic rsin or a thermosetting resin. For example, polyester, polyamide, polyethylene, polypropylene, polyvinyl chloride, polycarbonate, polyvinyl fluoride, polyacetal, polymethyl methacrylate, an epoxy resin, a melamine resin, a phenol resin, polyimide, and an ABS (acrylonitrile-butadiene-styrene) resin can be used.

The substrate further includes a fiber-reinforced resin containing fibrous materials. These fibrous materials can include inorganic fibers of, e.g., glass slag, carbon, boron, steel, and silicon carbide, and organic fibers of, e.g., polyester, polyamide, aramide, polypropylene, linen, and cotton. These fibrous materials are used in the form of short fibers, long fibers, disposed sheet, unwoven sheet, woven fabric, knitted fabric, or the like.

Depending on the shape of the resinous substrate, such as plate-like, hollow, and the irregularities thereof, a method of applying the undercoat composition of the present invention can be chosen appropriately. For example, the undercoat composition of the present invention can be coated by the spray method, the screen coating method, and the dipping method. In order to increase the adhesion between the undercoating layer and the substrate, it is preferred that the organic binder component be the same as that constituting the substrate. Conditions such as heating temperature and pressure under which the undercoat composition of the present invention is applied vary with the particular physical and chemical properties of the substrate.

The thickness of the undercoat layer is not critical. From a viewpoint of, e.g., the particle size of the spraying material in the practice of ceramic spraying, the thickness of the undercoat layer is preferably at least 10 μm.

The undercoat composition of the present invention is applied as described above to thereby form an undercoat layer on the surface or surface layer of the resinous substrate.

After the undercoat composition of the present invention is coated on the substrate to form an undercoat layer, ceramics are flame sprayed on the undercoat layer. As the ceramic flame spraying material, ceramics flame sprayed on the ordinary metallic substrate, for example, oxides such as alumina-titania, alumina, titania, chromium oxide, nickel oxide, cobalt oxide, zirconia, magnesium zirconate, spinel, and cesium oxide, and nitrides or carbides such as tungsten carbide, silicon carbide, chromium carbide, titanium nitride, silicon, zirconium nitride, and boron nitride can be used alone or as mixtures comprising two or more thereof. It is noted that the present invention is not limited to the foregoing compounds.

The ceramics can be flame sprayed by any suitable flame spraying method, such as the plasma jet spraying method, the gas spraying method, the ceramic rod gas flame spraying method, the detonation gun flame spraying method, and the electric arc spraying method. In flame spraying, of course, it is necessary to take into account the shape of the substrate to be flame sprayed, the type of the flame spraying material, the equipment, and other flame spraying conditions.

In the case that the ceramics has a high melting point and the heat source does not provide a sufficient heat, or as a method enabling flame spraying in a short period and with high efficiency, the plasma jet flame spraying method is particularly preferred in that it can form an excellent spray deposit. Flame spraying conditions can be easily conducted by a method of flame spraying ceramics on the ordinary metallic substrate.

The composite molded articles according to the present invention will hereinafter be explained in detail with reference to the attached drawings.

FIG. 1 is a schematic cross-sectional view of an composite molded article according to the present invention, in which an intermediate layer containing an inorganic filler is present on the surface of a resinous substrate. The composite molded article shown in FIG. 1 comprises a spray deposit 1 formed by flame spraying alumina-titania (60/40), an intermediate layer 2 consisting of a carbonyl nickel filler (Ni-255) having a high heat conductivity and a large surface area and an epoxy resin, and a resinous substrate 3 made of an ester resin.

Figure 2:
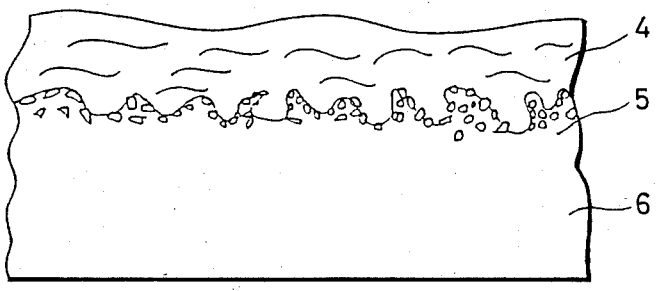
FIG. 2 is a schematic cross-sectional view of another composite molded article according to the present invention.

FIG. 2 is a schematic cross-sectional view of another composite molded article according to the present invention, in which an intermediate layer containing an inorganic filler is present in the surface of a resinous substrate. The composite molded article shown in FIG. 2 comprises a ceramic spray deposit 4, an intermediate layer 5 prepared with an epoxy resin with a Celite (trademark) filler (a kind of diatomaceous earth) dispersed therein, and a resinous substrate 6 made of an epoxy resin. This composite molded article is produced by molding an epoxy resin with a Celite filler dispersion therein and then applying flame spraying.

Figure 3:
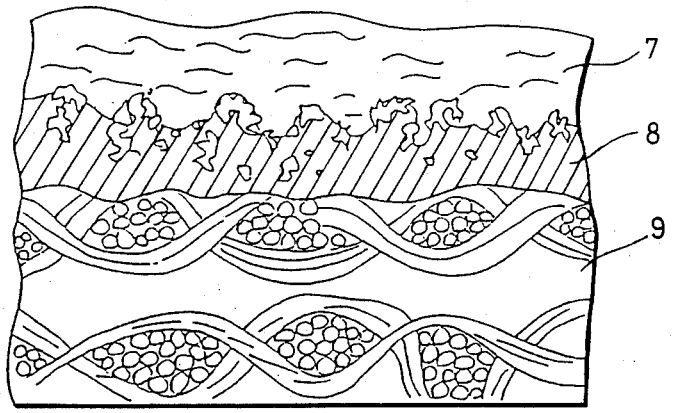
FIG. 3 is a schematic cross-sectional view of still another composite molded article according to the present invention.

FIG. 3 is a schematic cross-sectional view of still another composite molded article according to the present invention, in which the resinous substrate is a fiber-reinforced resin containing inorganic or organic fibers. The composite molded article shown in FIG. 3 comprises a zirconia spray deposit 7, an intermediate layer 8 made of a polyester resin with a carbonyl nickel (Ni-123) filler dispersed therein, and a substrate 9 comprising a glass fiber cloth and a polyester resin.

Figure 4:
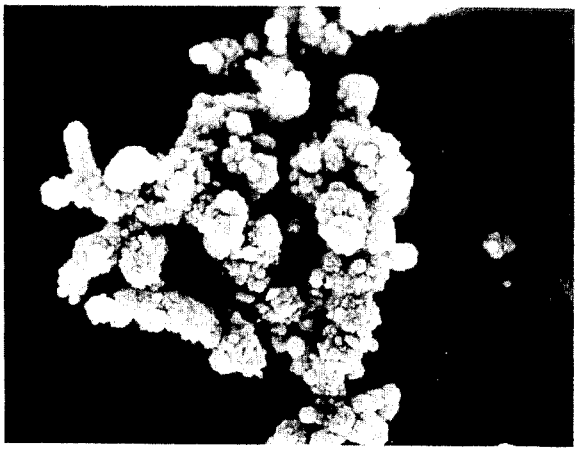
FIG. 4 is an enlarged microscopic photograph of spherical nickel powder having complex irregularities in the surface thereof.

FIG. 4 is an enlarged microscopic photograph of spherical nickel powder (type: Ni-255) having complex irregularities in the surface thereof, which is used as an inorganic filler in Example 1.

Figure 5:
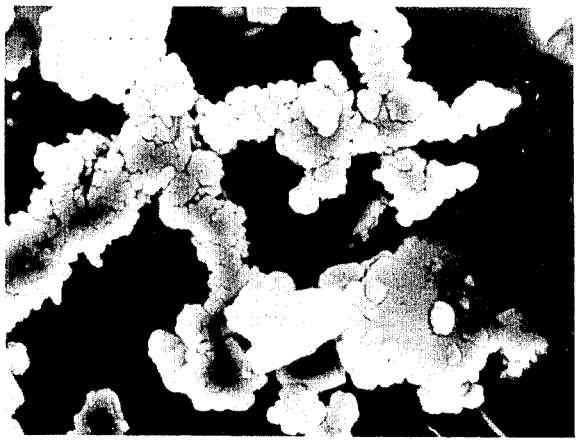
FIG. 5 is an enlarged microscopic photograph of plateshaped nickel powder not having complex irregularities in the surface thereof.

FIG. 5 is an enlarged microscopic photograph of plate-shaped nickel powder not having irregularities in the surface thereof, which is used as an inorganic filler in Comparative Example 4.

Application of the undercoat composition of the present invention onto the substrate provides several advantages. Heat is readily released from ceramic flame sprayed droplets and thus the residual stress at the time of forming the deposit can be decreased. Furthermore, the anchor effect between the spray deposit and the undercoat layer is increased and thus there can be obtained a composite molded article which is satisfactory not only in primary adhesion but also in environmental resistance and impact resistance. Thus the present invention is of high industrial value. Moreover, the application of the undercoat composition of the present invention permits flame spraying of ceramics on a resinous substrate, which has heretofore been considered impossible. Thus, it is expected that the composite molded article according to the present invention is widely used as a light-weight composite. The composite molded article according to the present invention can be used in various fields. For example, it can be used as an ordinary industrial part, such as a gear, a pulley, and a high-speed roller, for which are required light weight and abrasion resistance, or as a part used in fiber-producing machines, such as a thread guide, a rotary disc for twisting, a winding bobbin, and an extending pin for extension. Moreover, it can be used as a high-speed rotary polygon mirror, a turbo-charger rotar, or a golf club head.

The present invention is described in greater detail with reference to the following examples. Unless otherwise indicated, all percents, parts and ratios are by weight.

EXAMPLE 1

70 parts of a thermosetting acryl resin (Dianal HR-664 produced by Mitsubishi Rayon Co., Ltd.), 10 parts of a butyletherified melamine resin, and 5 parts of a bisphenol A-type epoxy resin (Epikote 1001 produced by Yuka-Shell Co., Ltd.) were mixed with 25 parts of xylene and 20 parts of methyl isobutyl ketone, and further kneaded with 121 parts of carbonyl nickel powder (type: Ni-225, produced by Japan International Nickel Co., Ltd.) to prepare an undercoat composition.

This undercoat composition was coated on a zinc phosphate-treated plate in a coating thickness of 100 μm, and then cured by heating at 130° C. for 60 minutes.

Subsequently, ceramic flame spraying was applied on the substrate with the undercoat composition coated thereon under the following conditions.

Flame spraying material: Alumina-titania (60/40) having a particle size of from 10 to 44 μm.
Carrier gas: Mixed gas of 20% He and 80% argon.
Equipment: Model 7MB produced by Daiichi Meteco Co., Ltd.
Flame spraying distance: 150 mm.

EXAMPLE 2 AND COMPARATIVE EXAMPLES 1 AND 2

The procedure of Example 1 was repeated wherein as the inorganic filler component, fillers as shown in Table 1 were used.

The results are shown in Table 1.

EXAMPLE 3 AND COMPARATIVE EXAMPLES 3 AND 4

Undercoat compositions were prepared in the same manner as in Example 1, except that as the inorganic filler component, fillers as shown in Table 1 were used.

Each undercoat composition was coated on a laminate having a thickness of 2 mm and a fiber volume content of 50 vol%, prepared by impregnating eight sheets of satin weave fabrics of carbon fibers with a bisphenol A-type epoxy resin (Epikote 828 produced by Yuka-Shell Co., Ltd.) and then thermosetting them in a laminated form. Thereafter, ceramic flame spraying was applied in the same manner as in Example 1. The results of evaluation of the composite molded article thus obtained are shown in Table 1.

COMPARATIVE EXAMPLE 5

Ceramic flame spraying was applied on a zinc phosphate-treated plate under the same conditions as in Example 1.

The results are shown in Table 1.

TABLE 1

| | Undercoat Composition | | | | | | |
|---|---|---|---|---|---|---|---|
| Example No. | Inorganic Filler | Shape | Complex Surface Irregularities | Amount (parts)*1 | λ | S | λ · S |
| Example 1 | Nickel powder | Spherical | Present | 124 | $1.4 \times 10^{-1}$ | 5.4 | $7.56 \times 10^{-1}$ |
| Example 2 | Diatonaceous earth | Amorphous | Present | 32 | $3.32 \times 10^{-3}$ | 20.0 | $6.64 \times 10^{-2}$ |
| Example 3 | Nickel powder | Spherical | Present | 124 | $1.4 \times 10^{-1}$ | 2.1 | $2.29 \times 10^{-1}$ |
| Comparative Example 1 | Zinc powder | Spherical | Not present | 99 | $3.0 \times 10^{-1}$ | 0.15 | $4.5 \times 10^{-2}$ |
| Comparative Example 2 | Alumina | Spherical | Not present | 55 | $8.0 \times 10^{-3}$ | 0.3 | $2.4 \times 10^{-3}$ |
| Comparative Example 3 | Silver powder | Flaky | Not present | 146 | $2.2 \times 10^{-1}$ | 0.2 | $4.4 \times 10^{-2}$ |

TABLE 1-continued

| | | | | | | | |
|---|---|---|---|---|---|---|---|
| Comparative Example 4 | Nickel powder | Plate-like | Not present | 124 | $1.4 \times 10^{-1}$ | 0.3 | $4.2 \times 10^{-2}$ |
| Comparative Example 5 | No undercoating | | | | | | |

| | | Physical Properties of Ceramic Flame Sprayed Composite Molded Article | | | |
|---|---|---|---|---|---|
| Example No. | Substrate | Deposit-Forming Properties*2 | Adhesion Force*3 | Impact Resistance*4 | Impact Resistance After Heat Cycle*5 |
| Example 1 | Zinc phosphate-treated steel plate | Excellent | 2.5 | 50 or more | 50 or more |
| Example 2 | Zinc phosphate-treated steel plate | Excellent | 2.4 | 50 | 45 |
| Example 3 | C.F.R.P.*6 | Excellent | 3.0 | 50 or more | 50 or more |
| Comparative Example 1 | Zinc phosphate-treated steel plate | Fair | 0.3 | 10 | 5 or less |
| Comparative Example 2 | Zinc phosphate-treated steel plate | Fair | 0.3 | 5 | 5 or less |
| Comparative Example 3 | C.F.R.P.*6 | X | 0.1 or less | 5 or less | 5 or less |
| Comparative Example 4 | " | X | 0.1 or less | 5 or less | 5 or less |
| Comparative Example 5 | Zinc phosphate-treated steel plate | X | 0.1 or less | 5 or less | 5 or less |

Note:
*1: Inorganic filler content of 25 vol %
*2: The rating was as follows:
Excellent: A uniform deposit was formed.
Fair: No trouble was encountered in the formation of deposit.
X: A deposit was not formed at all.
*3: Tensile adhesion strength (kg/mm$^2$)
*4: Dropping height (cm) at which abnormality was observed when tested with a DuPont type impact tester under a load of 300 g.
*5: A test cycle of 120° C. × 1 hour and −40° C. × 1 hour was repeated five times. Then the piece was tested with the Dupont type impact tester under a load of 300 g, and a dropping height (cm) at which abnormality was observed was indicated.
*6: Carbon Fiber Reinforced Plastics It can be seen from the results of Table 1 that when the undercoat composition of the present invention is applied, impact resistance and thermal impact resistance are good compared with the case wherein no undercoating is applied.

In the case of compositions using fillers not having irregularities in the surface thereof (Comparative Examples 1 to 4), deposit-forming properties were clearly poor as compared with those of Examples 1 to 3 of the present invention. Moreover, they were unsuitable for practical use in all respect, viz., with respect to adhesion force, impact resistance, and impact resistance after heating.

EXAMPLE 4

30 parts of a bisphenol A-type epoxy resin (Epikote 1009 produced by Yuka-Shell Co., Ltd.), 1 part of an imidazole-based compound, Curesol 2PZCN (produced by Shikoku Kasei Kogyo Co., Ltd.), and 70 parts of methyl isobutyl ketone were kneaded with 127 parts of granular nickel powder (carbonyl nickel, type 255, produced by Japan International Nickel Co., Ltd.) to prepare an undercoat composition.

This undercoat composition was spray coated on a soft steel plate which had been sand blasted, in a thickness of 100 μm and then cured by heating at 130° C. for 90 minutes.

Therefore, ceramic flame spraying was applied in the same manner as in Example 1.

EXAMPLE 5

A ceramic flame sprayed composite product was produced in the same manner as in Example 4, except that as the inorganic filler component, 127 parts of carbonyl nickel powder (type 123 produced by Japan International Nickel Co., Ltd.) was used.

The results are shown in Table 2.

EXAMPLE 6

A ceramic flame sprayed composite product was produced in the same manner as in Example 4, except that as the inorganic filler component, 32 parts of powdered diatomaceous earth was used.

The results are shown in Table 2.

EXAMPLE 7

A ceramic flame sprayed composite product was produced in the same manner as in Example 4, except that the substrate, a laminated plate having a thickness of 2 mm and a fiber volume content of 50 vol%, prepared by impregnating eight sheets of satin weave fabrics of carbon fibers with a bisphenol A-type epoxy resin (Epikote 828 produced by Yuka-Shell Co., Ltd.) as a matrix resin and then curing by heating, was used.

The results are shown in Table 2.

COMPARATIVE EXAMPLE 6

A ceramic flame sprayed composite product was produced in the same manner as in Example 4, except that as the inorganic filler component, 102 parts of powdered zinc (spherical) was used.

The results are shown in Table 2.

COMPARATIVE EXAMPLE 7

A ceramic flame sprayed composite product was produced in the same manner as in Example 4, except that as the inorganic filler component, 56 parts of powdered alumina (spherical) was used.

The results are shown in Table 2.

COMPARATIVE EXAMPLE 8

A ceramic flame sprayed composite product was produced in the same manner as in Example 4 except that 102 parts of powdered zinc (spherical) was used as the inorganic filler component, and C.F.R.P. (Carbon Fiber Reinforced Plastics) was used as the substrate.

The results are shown in Table 2.

COMPARATIVE EXAMPLE 9

A ceramic composite product was produced by applying ceramic flame spraying directly on C.F.R.P., which had been sand blasted, under the same conditions as in Example 4.

The results are shown in Table 2.

It can be seen from the results of Table 2 that when the undercoat composition of the present invention is used, ceramic flame spraying can be easily carried out, and a composite product having a high impact strength and a high abhesion force can be obtained.

EXAMPLE 8

40 parts of a bisphenol A-type epoxy resin (Epikote 834, produced by Yuka-Shell Co., Ltd.), 2 parts of an imidazole compound (Curezole 2PZ-CN, produced by Shikoku Kasei Kogyo Co., Ltd.), a given amount of an inorganic filler as shown in Table 3, and 70 parts of methyl isobutyl ketone were kneaded to prepare an undercoat composition. This undercoat composition was spray coated on various resinous substrates which had been sand blasted, in a thickness of about 100 μm and then hardened by heating at 80° C. for 2 hours.

Ceramic flame spraying was applied on the above-prepared undercoating under the following conditions.

Flame spraying material: Alumina having a particle size of 10 to 44 μm.

Carrier gas: Mixed gas of 90 parts of nitrogen and 10 parts of hydrogen.

Apparatus: Model 7MB produced by Daiichi Meteco Co., Ltd.

Flame spraying distance: 150 mm.

Each composite molded article thus obtained was measured for physical properties. The results are shown in Table 3.

TABLE 2

| | Undercoat Composition | | | | | | Physical Properties | | |
|---|---|---|---|---|---|---|---|---|---|
| Example No. | Filler Type | Amount (parts)*7 | λ*8 | S*9 | λ · S | Substrate | Adhesion Force*10 | Impact*11 Resistance | Deposit-forming*12 Properties |
| Example 4 | Carbonyl nickel (type 255) | 127 | $1.4 \times 10^{-1}$ | 5.4 | $7.56 \times 10^{-1}$ | Soft steel plate | 3.1 | 35 | Excellent |
| Example 5 | Carbonyl nickel (type 123) | 127 | $1.4 \times 10^{-1}$ | 2.1 | $2.94 \times 10^{-1}$ | Soft steel plate | 2.4 | 30 | Fair |
| Example 6 | Diatomaceous earth | 32 | $3.32 \times 10^{-3}$ | 20.0 | $6.64 \times 10^{-2}$ | Soft steel plate | 2.8 | 40 | Excellent |
| Example 7 | Carbonyl nickel (type 255) | 127 | $1.4 \times 10^{-1}$ | 5.4 | $7.56 \times 10^{-1}$ | C.F.R.P. | 3.0 | 45 | Excellent |
| Comparative Example 6 | Powdered zinc | 102 | $3.0 \times 10^{-1}$ | 0.15 | $4.5 \times 10^{-2}$ | Soft steel plate | 0.3 | 5 or less | X |
| Comparative Example 7 | Aluminum oxide | 56 | $8.0 \times 10^{-3}$ | 0.3 | $2.4 \times 10^{-3}$ | Soft steel plate | 0.3 | 5 or less | Poor–X |
| Comparative Example 8 | Powdered zinc | 102 | $3.0 \times 10^{-1}$ | 0.15 | $4.5 \times 10^{-2}$ | C.F.R.P. | 0.1 or less | 5 or less | Poor |
| Comparative Example 9 | No undercoating | | | | | C.F.R.P. | 0.1 or less | 5 or less | X |

*7Filler content of 30 vol %

*8Heat conductivity ($cal \cdot cm^{-1} \cdot sec^{-1} \cdot deg^{-1}$)

*9Surface area ($m^2 \cdot g^{-1}$) as determined by measuring the amount of nitrogen adsorbed by the chromatographic method.

*10Tensile adhesion strength ($kg/mm^2$)

*11Dropping height (cm) at which abnormality was observed when tested with the DuPont type impact tester and under a load of 300 g.

*12The rating was as follows:

Excellent: A coating was uniformly formed.

Fair: No trouble was encountered in forming the coating

Poor: A coating was formed partially

X: A coating was not formed at all

TABLE 3

| | | Inorganic Filler | | | | | Physical Properties of Ceramic Composite Molded Article | | |
|---|---|---|---|---|---|---|---|---|---|
| Example No. | Substrate | Type | Amount (parts)* | λ* | S* | λ· S | Deposit-Forming Properties | Adhesion Force* | Impact Resistance* |
| 8A | Thermosetting Epoxy Resin | Nickel (type 255) | 127 | $1.4 \times 10^{-1}$ | 5.4 | $7.56 \times 10^{-1}$ | Excellent | 3.1 | 35 |
| 8B | Methacryl | Nickel | 127 | $1.4 \times 10^{-1}$ | 5.4 | $7.56 \times 10^{-1}$ | Excellent | 3.0 | 25 |

TABLE 3-continued

| Example No. | Substrate | Inorganic Filler Type | Inorganic Filler Amount (parts)* | λ* | S* | λ·S | Physical Properties of Ceramic Composite Molded Article: Deposit-Forming Properties | Adhesion Force* | Impact Resistance* |
|---|---|---|---|---|---|---|---|---|---|
| 8C | Resin Methacryl Resin | (type 255) Diatomaceous earth | 32 | $3.2 \times 10^{-2}$ | 20.0 | $6.64 \times 10^{-2}$ | Fair | 2.1 | 25 |

Note:
*: Units and evaluation methods are the same as in Table 2.

It can be seen from the results of Table 3 that the present invention permits ceramic flame spraying on a resinous substrate, and furthermore permits production of a composite molded article having increased physical properties.

When, however, undercoat treatment was not applied, even if ceramic flame spraying was applied, no deposit was formed.

EXAMPLE 9

70 parts of a thermosetting acryl resin (Dianal HR-124, produced by Mitsubishi Rayon Co., Ltd.), 17 parts of a butyl etherified melamine resin (Super Beckamine J 820-60, produced by Dainippon Ink Co., Ltd.), 5 parts of a bisphenol A-type resin (Epikote 1001, produced by Yuka-Shell Co., Ltd.), 25 parts of toluene, and 25 parts of methyl isobutyl ketone were mixed, and 159 parts of powdered carbonyl nickel (type Ni-255) was added. The resulting mixture was kneaded to prepare an undercoat composition.

This undercoat composition was spray coated on a soft steel plate which had been sand blasted and then cured by heating at 130° C. for 60 minutes. Thereafter, ceramic flame spraying was applied under the same conditions as in Example 1. The composite molded article thus obtained was measured for physical properties. The results are shown in Table 4.

EXAMPLE 10

A composite molded article was produced in the same manner as in Example 9 except that as the inorganic filler component, 93 parts of powdered carbonyl nickel (type Ni-255) was used.

The composite molded article thus obtained was measured for physical properties. The results are shown in Table 4.

COMPARATIVE EXAMPLE 10

A composite molded article was produced in the same manner as in Example 9, except that as the inorganic filler component, 41 parts of powdered carbonyl nickel (type Ni-255) was used.

The composite molded article thus obtained was measured for physical properties. The results are shown in Table 4.

COMPARATIVE EXAMPLE 11

Ceramic flame spraying alone was applied to a soft steel plate which had been sand blasted under the same conditions as in Example 5.

The thus-produced composite molded article was measured for physical properties. The results are shown in Table 4.

TABLE 4

| Example No. | Filler Content Amount (Parts)** | Physical Properties of Ceramic Flame Sprayed Composite Molded Article: Deposit-Forming Properties** | Adhesion Force ($kg/mm^2$): Initial Stage | After Thermal Impact Testing | Retention Ratio*** (%) |
|---|---|---|---|---|---|
| Example 9 | 159 | Excellent | 2.5 | 2.5 | 100 |
| Example 10 | 93 | Excellent | 2.3 | 2.1 | 91 |
| Comparative Example 10 | 41 | Fair–Poor | 1.7 | 1.0 | 59 |
| Comparative Example 11 | — | Poor | 1.6 | Not more than 0.5 | Not more than 31 |

Note:
**: Units and evaluation methods are the same as in Table 2.
***: $\frac{\text{Adhesion strength after thermal Impact testing}}{\text{Initial adhesion strength}} \times 100\ (\%)$
Thermal Impact Test: Cycle of 120° C. for 1 hour and −40° C. for 1 hour was repeatd five times.

It can be seen from the results of Table 4 that if the undercoat composition of the present invention is used, a ceramic composite molded article having good environmental resistance can be obtained.

While the invention has been described in detail and with reference to specific embodiments thereof, it will be apparent to one skilled in the art that various changes and modifications can be made therein without departing from the spirit and scope thereof.

What is claimed is:

1. A composite molded article comprising a substrate, a ceramic flame sprayed coating, and an intermediate layer between the substrate and the ceramic sprayed coating, wherein the intermediate layer consists essentially of an inorganic filler component having complex irregularities in the surface thereof and which satisfies the relationship:

$$\lambda \cdot S \geqq 5.0 \times 10^{-2} \quad (1)$$

wherein λ is heat conductivity in $cal.cm^{-1}.sec^{-1}.deg^{-1}$, and S is surface area in $m^2 \cdot g^{-1}$, and an organic binder component.

2. A composite molded article as in claim 1, wherein the substrate is a molded article made of a synthetic resin.

3. A composite molded article as in claim 1, wherein the substrate is a molded article made of a fiber-reinforced resin.

4. A composite molded article as in claim 1, wherein the inorganic filler component content of the intermediate layer is from 15 to 80 vol%.

5. A composite molded article as in claim 1, wherein the inorganic filler component content of the intermediate layer is from 20 to 60 vol%.

6. A composite molded article as in claim 2, wherein the organic binder component of the intermediate layer is the same as the synthetic resin constituting the substrate.

7. A composite molded article as in claim 3, wherein the organic binder component of the intermediate layer is the same as the fiber-reinforced resin constituting the substrate.

8. A composite molded article as in claim 1, wherein the thickness of the intermediate layer is at least 10 μm.

* * * * *